US008317533B2

(12) United States Patent
Ishimaru

(10) Patent No.: US 8,317,533 B2
(45) Date of Patent: Nov. 27, 2012

(54) ELECTRIC CONNECTOR WITH A LOCK MEMBER ON AN ELASTICALLY DISPLACEABLE LOCK ARM

(75) Inventor: Masao Ishimaru, Machida (JP)

(73) Assignee: Dai-Ichi Seiko Co., Ltd., Kyoto (JP)

( * ) Notice: Subject to any disclaimer, the term of this patent is extended or adjusted under 35 U.S.C. 154(b) by 0 days.

(21) Appl. No.: 13/198,014

(22) Filed: Aug. 4, 2011

(65) Prior Publication Data

US 2012/0214329 A1 Aug. 23, 2012

(30) Foreign Application Priority Data

Feb. 22, 2011 (JP) ..... 2011-035411

(51) Int. Cl.
*H01R 13/62* (2006.01)

(52) U.S. Cl. ..... 439/345

(58) Field of Classification Search ..... 439/345, 439/153–160, 347, 353, 357, 372
See application file for complete search history.

(56) References Cited

U.S. PATENT DOCUMENTS 5,302,133 A * 4/1994 Tondreault ..... 439/157
5,470,240 A * 11/1995 Suzuki ..... 439/157
6,379,168 B1 * 4/2002 Wang ..... 439/160
6,767,230 B2 * 7/2004 Lai ..... 439/153
7,938,657 B2 * 5/2011 Tang et al. ..... 439/160
2012/0100742 A1 * 4/2012 Ishimaru ..... 439/345

FOREIGN PATENT DOCUMENTS

JP 2001-196130 7/2001
JP 2003-100370 4/2003

OTHER PUBLICATIONS

U.S. Appl. No. 29/397,662, filed Jul. 19, 2011, Ishimaru.
U.S. Appl. No. 13/242,201, filed Sep. 23, 2011, Ishimaru.

* cited by examiner

*Primary Examiner* — Chandrika Prasad
(74) *Attorney, Agent, or Firm* — Oblon, Spivak, McClelland, Maier & Neustadt, L.L.P.

(57) ABSTRACT

To allow a signal transmission medium inserted in a connector main body to be held and disengaged excellently with a simple structure, the structure is such that a lock member holding a signal transmission medium inserted in the connector main body is provided to a part of an elastically-displaceable lock arm member extending like a cantilever from a rocking fulcrum and disposed at one end of the connector main body on a rising side to excellently maintain a state of holding the signal transmission medium by the lock member with an elastic action of the lock arm member, a release operation from the lock member is easily performed with a relatively small operation force, and a load transmitted from the lock member to the lock arm member when the signal transmission medium is inserted or withdrawn is received at the end of the connector main body on the rising side to reduce direct load on a circuit wiring board side.

5 Claims, 10 Drawing Sheets

(A)

(B)

ELECTRIC CONNECTOR WITH A LOCK MEMBER ON AN ELASTICALLY DISPLACEABLE LOCK ARM

BACKGROUND OF THE INVENTION

1. Field of the Invention

The present invention relates to an electric connector configured so that a signal transmission medium inserted in a connector main body is easily held by a lock member.

2. Description of the Related Art

Conventionally, an electric connector for electrically connecting a signal transmission medium, such as a flexible flat cable (FFC) or a flexible printed circuit (FPC), to a circuit wiring board in various electric apparatuses and others has been widely adopted. This electric connector is mounted, for example, via a board connection leg part (a hold-down) soldered to a circuit wiring board so that a connector main body rises upward from the surface of the circuit wiring board and, with the signal transmission medium being inserted inwardly from an insert opening provided at an upper end of the connector main body of the electric connector, electric connection is made.

The signal transmission medium to be inserted in the electric connector in the above-described manner has a terminal portion on an insertion side formed with a positioning part composed of, for example, a notched concave part. In this structure, with a lock member provided on an electric connector side being engaged in this positioning part provided on a signal transmission medium side, the state of insertion of the signal transmission medium is held. For example, in Japanese Unexamined Patent Application Publication No. 2001-196130, a structure is adopted in which, in order not to use a slider for obtaining contact pressure between a contact group held in the connector main body and the signal transmission medium (FPC/FFC), a lock lever is pivotally attached so as to prevent drop-off of the signal transmission medium even with a small contact load.

In this case, however, since the lock member provided to the connector main body is molded as a separate member, the number of components is increased. For this and other reasons, the entire connector tends to be expensive. Moreover, since the structure is such that the lock member is engaged under its own weight with the signal transmission medium side, it is disadvantageously impossible to achieve sufficient power of holding the signal transmission medium.

Furthermore, in another electric connector described in Japanese Unexamined Patent Application Publication No. 2003-100370, a reinforcing fitting to be mounted on both ends of a housing and soldered to a circuit wiring board is provided with an elastic supporting piece elastically pressing and supporting a signal transmission medium (FPC/FFC), thereby allowing prevention of a positional shift of the signal transmission medium and others. However, since the acting direction of the pressure force by the elastic supporting piece and a soldered part of the reinforcing fitting have a positionally shifted relation, if the release operation of the lock member is repeated again and again, an influence occurs to the mount state of the connector main body and others due to a release operation force continuously added to the connector main body, thereby possibly causing the electric connection to be unstable.

SUMMARY OF THE INVENTION

Therefore, an object of the present invention is to provide an electric connector allowing a signal transmission medium inserted in a connector main body to be held and disengaged excellently with a simple structure.

To achieve the above-described object, an electric connector according to the present invention electrically connects a signal transmission medium to a circuit wiring board, the electric connector including: a connector main body to be mounted on a surface of the circuit wiring board via a board connection leg part soldered to the circuit wiring board; an insertion opening provided at one end of the connector main body so as to allow the signal transmission medium to be inserted in the connector main body; and a lock member holding an insertion state of the signal transmission medium by being engaged in a part of the signal transmission medium inserted from the insertion opening in the connector main body, wherein the lock member is provided to a part of an elastically-displaceable lock arm member extending like a cantilever from a rocking fulcrum disposed at the one end of the connector main body, and the electric connector is configured so that the lock member is engaged in the signal transmission medium with an elastic force of the lock arm member.

According to this structure, while the state of holding the signal transmission medium by the lock member is excellently maintained with the elastic action of the lock arm member formed of the rocking member, the lock arm member extends up to the lock member on a rocking side from one end of the connector main body where the rocking fulcrum is provided and has a relatively long rocking radius. Therefore, the operation of releasing the lock member holding the signal transmission medium is easily performed with a relatively small operation force.

Furthermore, since the rocking fulcrum of the lock arm member is disposed at one end of the connector main body, a load transmitted from the lock member to the lock arm member when the signal transmission medium is inserted or withdrawn is received by the one end of the connector main body, thereby reducing a direct load on a circuit wiring board side to which the board connection leg parts are connected. In particular, the possibility of damages and the like can be avoided when the circuit wiring board does not have sufficient stiffness because the circuit wiring board is thin or does not have a holding member. Therefore, even when the operation of releasing the lock member is repeated many times, an influence on the mount state of the connector main body and others can be reduced, and the electric connection state can be stably maintained over a long period.

Also, preferably in the present invention, the connector main body is provided with a lock release mechanism disengaging the lock member from the signal transmission medium, the lock release mechanism has a lock release arm member rocking in a plane approximately orthogonal to a rocking plane of the lock arm member, and is configured to rock the lock arm member with the rocking of the lock release arm member to release the lock member from the signal transmission medium. For example, preferably, the connector main body is mounted so as to rise from the surface of the circuit wiring board, the lock arm member extends so as to fall from an end of the connector main body on a rising side toward the circuit wiring board, the lock release arm member is formed so as to integrally extend like a cantilever from a wall of an insulating housing configuring the connector main body, and the lock release arm member extends in a direction of a plane approximately parallel to the circuit wiring board.

According to this structure, when the lock release operation of disengaging the lock member from the signal transmission medium is performed, as a rocking plane of the lock release arm member associated with the lock release operation, a plane approximately orthogonal to the rocking plane of the lock arm member is set, such as a plane approximately parallel to the circuit wiring board. Therefore, the operation force of releasing the lock member is not directly exerted on the lock arm member or the lock member, and the direct load on the circuit wiring board side is further reduced.

Also, according to this structure, since the pressing direction when the lock release operation of disengaging the lock member from the signal transmission medium is performed is approximately parallel to the circuit wiring board, the load is not exerted on the circuit wiring board.

Furthermore, when the signal transmission medium is inserted in the insertion opening of the connector main body, a positional relation between the insertion opening of the connector main body and the signal transmission medium can be easily observed from above. Therefore, the operation of inserting the signal transmission medium can be easily and accurately performed, and the state of the signal transmission medium after insertion can be excellently ensured.

Still further, preferably, the lock release arm member in the present invention is additionally provided with a release operation part adding a rocking force to the lock release arm member, and the release operation part is disposed so as to protrude outward from the connector main body.

According to this structure, the operation on the release operating part can be easily performed when the lock member is disengaged from the signal transmission medium.

Still further, the insulating housing in the present invention is preferably provided with a lock release movement regulating member regulating a moving range of the lock release arm member or the release operation part.

According to this structure, a release operation and other operations can be performed safely when the lock member is removed from the signal transmission medium, and breakage and damage of the lock release mechanism and the connector main body can be prevented.

As described above, in the electric connector according to the present invention, with the structure in which the lock member holding an insertion state of the signal transmission medium inserted from the insertion opening provided at one end of the connector main body is provided to a part of the elastically-displaceable lock arm member extending like a cantilever from the rocking fulcrum toward a circuit wiring board side and disposed at one end of the connector main body and the lock member is engaged in the signal transmission medium with an elastic force of the lock arm member, the state of holding the signal transmission medium by the lock member is excellently maintained with an elastic action of the lock arm member. Also, the operation of releasing the lock member is easily performed with a relative small operation force, and the load transmitted from the lock member to the lock arm member when the signal transmission medium is inserted or disengaged is received by the one end of the connector main body to reduce a direct load on the circuit wiring board side and avoid damages and others in the circuit wiring board. Furthermore, the electric connection state is stably maintained for a long time at low cost. Therefore, the signal transmission medium inserted in the connector main body can be excellently held or disengaged with a simple structure, and reliability of the electric connector can be significantly increased at low cost.

DETAILED DESCRIPTION OF THE PREFERRED EMBODIMENTS

An embodiment when the present invention is applied to an electric connector is described in detail below based on the drawings.

[Regarding Entire structure of Electric Connector]

An electric connector 1 according to an embodiment of the present invention depicted in FIG. 1 to FIG. 19 is formed of an electric connector mounted on a circuit wiring board (not shown) configuring a part of an electric circuit on an electric apparatus side. The electric connector 1 has a connector main body 11 disposed so as to rise in a vertical direction with respect to a surface of the circuit wiring board approximately horizontally disposed. The connector main body 11 includes an insulating housing 11*a* extending in an elongated shape along the surface of the circuit wiring board.

It is hereinafter assumed that the surface of the circuit wiring board (not shown) extends in a horizontal state, and a direction in which the connector main body 11 rises from the surface of the circuit wiring board is referred to as an "upward direction" and a direction opposite to the rising direction of the connector main body 11 is referred to as a "downward direction". It is also assumed that an extending direction of the elongated shape of the insulating housing 11*a* configuring the connector main body 11 is referred to as a "connector longitudinal direction" and a direction orthogonal to both of the "connector longitudinal direction" and an "upward/downward direction" is referred to as a "forward/backward direction".

Figure 15:
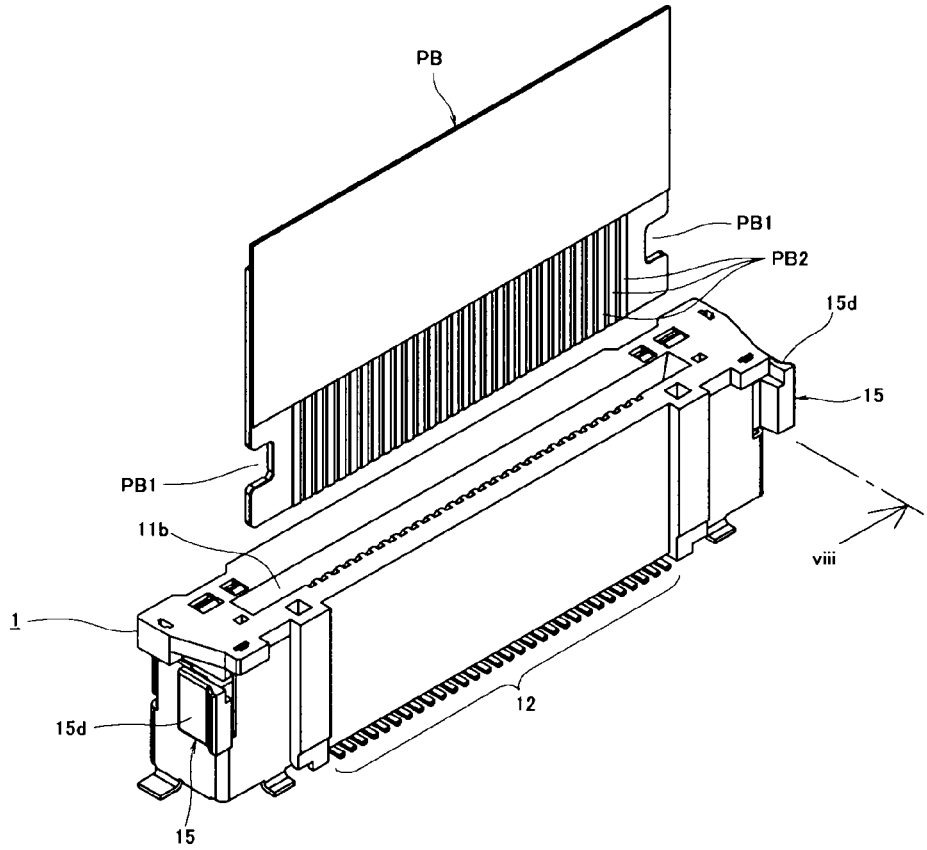
FIG. 15 is an external perspective view for describing the state before a signal transmission medium (FFC) is inserted in the electric connector depicted in FIG. 1 and FIG. 2.
Figure 16:
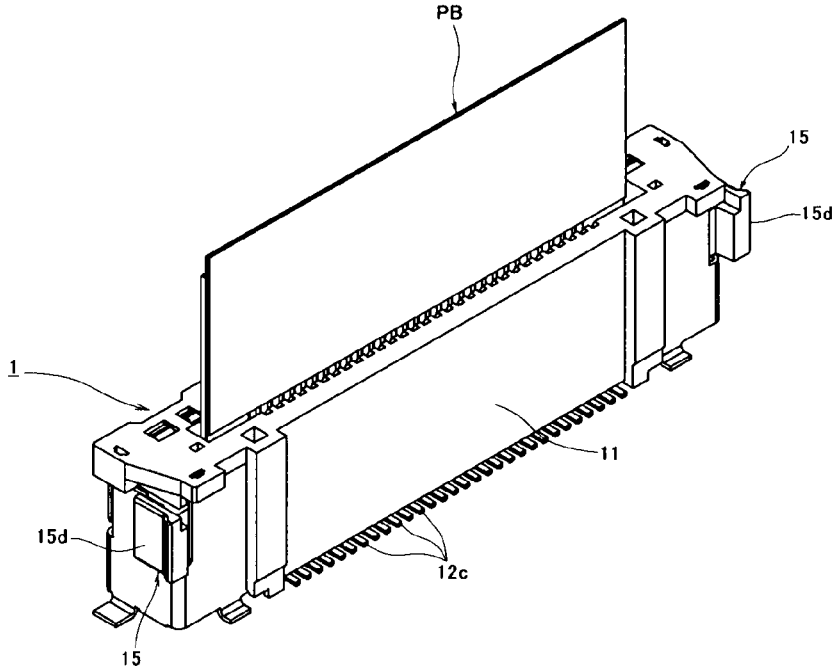
FIG. 16 is an external perspective view for describing the state in which insertion of the signal transmission medium (FFC) has been completed from the state of FIG. 15.
Figure 17:
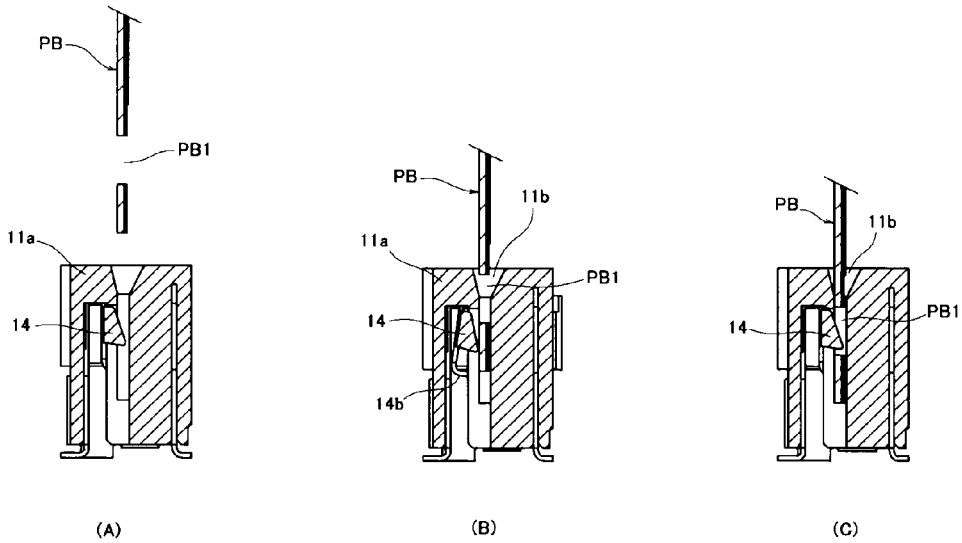
FIG. 17A, FIG. 17B, and FIG. 17C depict a sectional shape of a position of the signal transmission medium (FFC) depicted in FIG. 15 where a positioning part is provided, FIG. 17A being a sectional view for describing the state before the signal transmission medium (FFC) is inserted, FIG. 17B being a sectional view for describing the state in which the signal transmission medium (FFC) is inserted partway, and FIG. 17C being a sectional view for describing the state insertion of the signal transmission medium (FFC) has been completed.

On an upper end face, which is one end of the above-described insulating housing 11*a* on a rising side, an insertion opening 11*b* in which a signal transmission medium PB such as a flexible flat cable (FFC) or a flexible printed circuit (FPC), which will be described further below, is inserted is formed so as to form an elongated slit shape along the connector longitudinal direction. This insertion opening 11*b* extends downward to the inside of the insulating housing 11*a* to form a hollow space for receiving a terminal portion of the signal transmission medium PB. For example, as depicted in FIG. 15, the terminal portion of the signal transmission medium PB is disposed as rising toward the downward direction so as to be approximately orthogonal to the surface of the circuit wiring board (not shown). By being moved downward in this state, the terminal portion of the signal transmission medium PB is inserted in the hollow inside of the electric connector 1 through the insertion opening 11*b*, as depicted in FIG. 16.

According to this structure of insertion of the signal transmission medium PB from an upper side, when the signal transmission medium PB is inserted in the insertion opening 11*b* of the connector main body 11, a positional relation between the insertion opening 11*b* and the signal transmission medium PB can be easily observed from above. Therefore, the operation of inserting the signal transmission medium PB can be easily and accurately performed, and the state of the signal transmission medium PB after insertion can be excellently ensured.

[Insulating Housing and Conductive Contact]

In the hollow inside of the insulating housing 11*a* in which the terminal portion of the signal transmission medium PB such as a flexible flat cable (FFC) or a flexible printed circuit (FPC) is inserted, particularly as depicted in FIGS. 9A and 9B, conductive contacts (conductive terminals) 12 are disposed so as to extend in the upward/downward direction. These many conductive contacts 12 are mounted in a multi-contact manner with predetermined pitch spaces along the connector longitudinal direction of the insulating housing 11*a*, and each have a flexible beam part 12*a* disposed in the hollow space of the insulating housing 11*a* and also each include a connection terminal part 12*b* to be in contact with the circuit wiring board (not shown) at a lower end of the flexible beam part 12*a*.

The connection terminal part 12*b* provided at the lower end of each conductive contact 12 extends toward a rear side (a right side in FIG. 9A and FIG. 9B) to protrude outward from the insulating housing 11*a*, and has a tip part (a rear-end part) on an protruding side solder-jointed to a conductive path (not shown) formed on the surface of the circuit wiring board (not shown). Also, from an inner end side portion opposite to the solder-joint part of the connection terminal part 12*b*, the above-described flexible beam part 12*a* extends like a cantilever as being bent upward at an approximately right angle. This flexible beam part 12*a* extends so as to rise upward along the hollow inside of the insulating housing 11*a*, and a contact part 12*c* to be in contact with terminal parts PB2 (refer to FIG. 15) provided at the terminal portion of the signal transmission medium PB is formed at an upper portion of the flexible beam part 12*a*.

[Regarding Hold-Downs]

Furthermore, on both end portions of the above-described insulating housing 11*a* in the connector longitudinal direction, paired hold-downs 13, 13 formed by molding a thin-plate metal member in a bent shape are provided. Each of these hold-downs 13 has a base frame plate 13*a* surrounding the corresponding end portion of the insulating housing 11*a* in the connector longitudinal direction from outside approximately in an inverted C shape in a planar view. On a front portion and a rear portion of the base frame plate 13*a* at its lower end edge, paired board connection leg parts 13*b*, 13*b* protruding in the forward/backward direction are provided. On a side part of the base frame plate 13*a* at the lower end edge, a board connection leg part 13*c* protruding outward in the connection longitudinal direction is integrally provided.

Each of these board connection leg parts 13*b*, 13*b*, 13*c* is formed of a plate-like member protruding outward from the lower end edge of the above-described base frame plate 13*a*, and has its tip side portion formed so as to approximately horizontally extend. Each of these board connection leg parts 13*b*, 13*b*, 13*c* has its tip portion on an extending side solder-jointed to a connection part (not shown) formed on the surface of the above-described circuit wiring board (not shown). With this, the entire electric connector 1 is fixed onto the circuit wiring board.

On the other hand, at an upper end edge portion of the above-described base frame plate 13*a*, a plurality of plate-like engaging parts 13*d* are formed so as to each protrude upward. With each of these plate-like engaging parts 13*d* press-fitted inside the insulating housing 11*a*, the entire hold-down 13 are fixed to the insulating housing 11*a*.

[Regarding Signal Transmission Medium]

Next, particularly as depicted in FIG. 15, at the terminal portion of the signal transmission medium PB to be inserted in the connector main body 11 in the manner as described above, the terminal parts PB2 are formed at a tip exposed portion correspondingly to the conductive contacts 12 with predetermined pitch spaces in a width direction. Also, a positioning part PB1 composed of a notched concave part is formed at an end edge portion on both sides in the width direction. In this positioning part PB1 provided to the signal transmission medium PB, a lock member 14 provided on that electric connector 1 side is configured to be engaged when the signal transmission medium PB is inserted in the electric connector 1. With this engagement of the lock member 14, the insertion state of the signal transmission medium PB is held.

[Regarding Lock member]

The lock member 14 herein is integrally formed with the hold-downs 13 disposed on both end portions in the above-described connector longitudinal direction, and is provided to a part of a lock arm member 14*a* formed of a beam-like member provided so as to be elastically displaceable. This lock arm member 14*a* extends so as to form a Y shape from a rising end of the connector main body 11 on a front side, and extends so as to bend in a curved shape toward a connector's inner side from the upper end edge where the above-described base frame plate 13*a* extends up to the vicinity of the insertion opening 11*b* to be folded back downward. This downward folded-back portion provided at the upper end portion of the lock arm member 14*a* is formed at a rocking fulcrum P of the lock arm member 14*a*, and the lock arm member 14*a* is formed as an elastically-displaceable rocking member extending like a cantilever from the rocking fulcrum P on the upper end side toward the downward direction.

Here, the downward folded-back portion of the above-described lock arm member 14*a* including the upper-end rocking fulcrum P is configured so as to be separated into two folded portions in the connector longitudinal direction to excellently ensure both of flexibility and stiffness of the lock arm member 14*a*. The reason why the upper-end base end portion (downward folded-back portion) of the lock arm member 14*a* is configured in a Y shape is that the lock member 14 and a lock releasing part 14*b* are positionally shifted in a width direction of the lock arm member 14*a*. That is, firstly, if the upper-end base end portion of the lock arm member 14*a* is formed not in a Y shape but in an integrally contiguous shape, the stiffness of that integrally-contiguous portion is too large to obtain sufficient flexibility of the lock arm member 14*a*. Also, if the width dimension of the integrally-contiguous upper-end base end portion is reduced to ensure flexibility of the lock arm member 14*a*, a problem occurs in torsional stiffness. That is, since the lock member 14 and the lock releasing part 14*b* are positionally shifted in the width direction as described above, a force added to the lock member 14 when the signal transmission medium PB is inserted or when the signal transmission medium PB is in a held state after insertion is forcibly pulled out may cause plastic deformation of the lock arm member 14*a* in a torsional direction. Therefore, if the upper-end base end portion (downward folded-back portion) of the lock arm member 14*a* has a Y-shape structure as in the present embodiment, stiffness required against the load on the lock member 14 can be obtained while flexibility of the lock arm member 14*a* is excellently maintained at the same time.

Furthermore, the lock arm member 14*a* formed so as to form a Y shape at a base end portion on an upper end side is integrally coupled to a portion extending by a predetermined amount from the above-described rocking fulcrum P, and the above-described lock member 14 is provided at a side edge portion on an inner side (a connector center side) of that integrally coupled portion in the connector longitudinal direction, and a lock releasing part 14*b*, which will be described further below, is provided to a lower end portion on an outer side (a connector outer end side) in the connector longitudinal direction.

Among the above, the lock member 14 is formed of an approximately triangular hook-like member and, as described above, protrudes from the side edge of the lock arm member 14*a* toward the hollow inside of the insulating housing 11*a* so as to be bent at an approximately right angle. A lower end edge corresponding to the base of the triangle configuring an outer shape of this lock member 14 serves as an engaging edge that can be engaged with the inner edge portion of the positioning part PB1 provided to the above-described signal transmission medium PB. Also, from a top part provided to a protruding side portion of the engaging edge of the lock member 14, a guide edge having a guiding function for the positioning part P1 of the above-described signal transmission medium PB extends so as to form an inclined surface upward.

[Regarding Lock Release Mechanism]

Furthermore, the lock releasing part 14*b* is disposed on a connector outer side of the lock member 14 so as to be adjacent thereto. This lock releasing part 14*b* is formed of a plate-like member protruding rearward so as to form an approximately L shape in a side view from a lower end of the above-described lock arm member 14*a*, and a pressed surface is formed so as to rise upward at an approximately right angle from the tip on a protruding side. A release acting part 15*b* provided to a rock release mechanism 15, which will be described further below, presses and abuts on the pressed surface of the lock releasing part 14*b* and, with that pressing operation force, the lock member 14 together with the lock arm member 14*a* is elastically deformed so as to warp to a front side.

That is, the lock release mechanism 15 has a function of disengaging the above-described lock member 14 from the positioning part PB1 of the signal transmission medium PB, and is disposed at both end portions of the insulating housing 11*a* configuring the above-described connector main body 11 in the connector longitudinal direction. The release acting part 15*b* is provided to a part of the lock release arm member 15*a* integrally formed with the insulating housing 11*a*.

Figure 18:
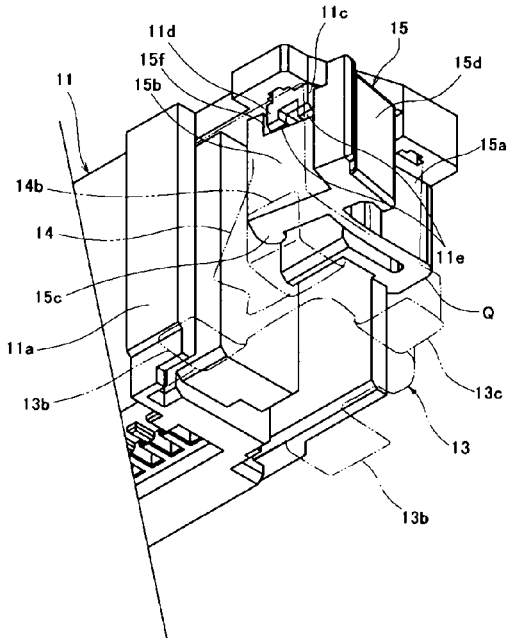
FIG. 18 is a partial view for describing the insulating housing for use in the electric connector depicted in FIG. 1 and FIG. 2 and viewed from a lower rear side.

The lock release arm member 15*a* is formed of, particularly as depicted in FIG. 18 and FIG. 14A, a rocking member integrally extending like a cantilever rearward from a rocking fulcrum Q provided on a wall of the insulating housing 11*a* on a frontside. The rocking member configuring the lock release arm member 15*a* is formed of a plate-like member extending so as to be elastically deformable in a rocking plane, more specifically, a rocking plane extending approximately horizontally (in a direction parallel to the circuit wiring board on which the electric connector 1 is to be mounted).

Also, the above-described release acting part 15*b* is connected to a tip portion (a rear end portion) of the lock release arm member 15*a* on a rocking side, and is formed of a plate-like member extending approximately horizontally from the connecting portion toward the inside (connector center side) in the connector longitudinal direction. At the end edge of this release acting part 15*b* on a connector center side, an abutting part 15*c* formed with a horizontal cross section shaped like an approximately arc shape is provided to protrude therefrom. This abutting part 15*c* is formed so as to form a convex shape, and is disposed so as to be able to abut on the pressed rising surface of the lock releasing part 14*b* from a rearward.

Furthermore, to the above-described release acting part 15*b*, a release operating part 15*d* is integrally provided on an outer end side (a connector outer end side) in the connector longitudinal direction. This release operating part 15*d* is disposed so as to protrude from the hold-down 13 outward for exposure, and an operation surface is provided to which an operation force to an inner side (connector center side) in the connector longitudinal direction can be added by the fingers of an assembly worker in a direction approximately horizontal (parallel to the circuit wiring board on which the electric connector 1 is to be mounted). When no operation force of the assembly worker is added to this release operating part 15*d*, the abutting part 15*c* of the above-described lock release mechanism 15 is in the state of abutting on the lock releasing part 14*b*, and no operation force is added to the lock arm member 14*a*. Therefore, with an elastic force of the lock arm member 14*a*, an initial state of the above-described lock member 14 is maintained. As such, with the lock arm member 14*a* and the lock member 14 being maintained in an initial state, the lock member 14 is engaged in the positioning part PB1 of the signal transmission medium PB inserted in the electric connector 1.

That is, as depicted in FIG. 17A, when the terminal portion of the signal transmission medium PB is inserted in the hollow inside through the insertion opening 11*b* of the connector main body 11, the terminal portion of the signal transmission medium PB abuts on the above-described inclined guide edge of the lock member 14 in the initial state. Then, as depicted in FIG. 17B, with the lock member 14 pressed frontward, the lock arm member 14*a* in an approximately upright state as an initial state is warped and elastically deformed so as to fall down frontward centering on the rocking fulcrum P on the upper end side. With this, the lock member 14 is retracted frontward from the hollow inside of the connector main body 11, thereby causing the terminal part of the signal transmission medium PB to continuously fall down without any trouble. Furthermore, while the terminal portion of the signal transmission medium PB is being pressed downward, as depicted in FIG. 17C, the lower-end engaging edge of the lock member 14 is rocked so as to fall into the inside of the positioning part (notched concave part) PB1 of the signal transmission medium PB with elastic resilience of the lock arm member 14*a*. With this, the lock member 14 is in the state of being engaged in the positioning part PB1 of the signal transmission medium PB, and the signal transmission medium PB is held in an insertion state.

On the other hand, from this insertion held state of the signal transmission medium PB, when an operation force by the assembly worker is added to the release operating part 15*d* of the above-described lock release mechanism 15 toward an inner side (connector center side) in the connector longitudinal direction, the lock release arm member 15*a* is elastically deformed via the release acting part 15*b*, and the abutting part 15*c* provided to the release acting part 15*b* presses the pressed rising surface of the lock releasing part 14*b*, thereby casing the lock arm member 14*a* together with the lock member 14 to be warped so as to fall down frontward against the elastic force of its own. With this, the lock member 14 is retracted from the hollow inside of the connector main body 11, the lock member 14 is disengaged from the positioning part PB1 of the signal transmission medium PB to cause the signal transmission medium PB to be in an open state, thereby allowing upward withdrawal of the signal transmission medium PB.

[Regarding Lock Release Movement Regulating Member]

Figure 19:
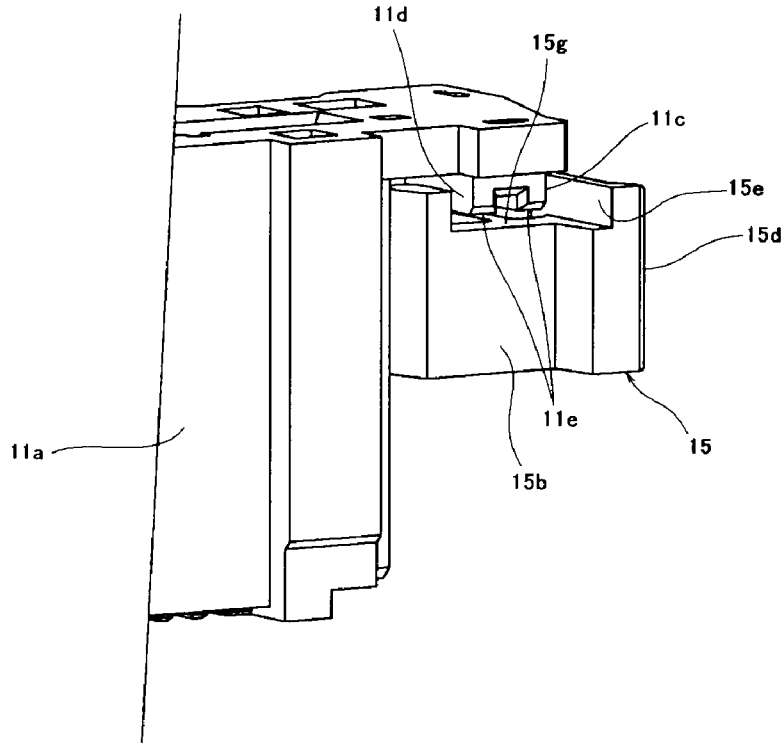
FIG. 19 is a partial view for describing the insulating housing depicted in FIG. 18 and viewed from an upper rear side.

The above-described lock release mechanism 15 is added with a lock release movement regulating member against the operation force in an operating direction of the lock release mechanism 15 and the upward/downward direction orthogonal to the operating direction. This lock release movement regulating member includes the above-described release operating part 15*d* and a plurality of stopper members provided to the hold-down 13 and the insulating housing 11. In particular, as depicted in FIG. 18 and FIG. 19, a first stopper part 15*e* is provided on an upper side of the above-described release operating part 15*d* and an inner side in the connector longitudinal direction, and a second stopper part 15*f* is provided on an upper side of the release acting part 15*b* and to a rising part on an inner side in the connector longitudinal direction. Similarly, a third stopper part 15*g* is provided on an upper surface of the release acting part 15*b*. Furthermore, the insulating housing 11 is provided with a first stopper part 11*c*, a second stopper part 11*d*, and a third stopper part 11*e* corresponding to the above-described first stopper part 15*e*, second stopper part 15*f*, and third stopper part 15*g* (Note in FIG. 18 that, for description of each component, the lock release arm par 15*a* is in a state of being warped outward in the connector longitudinal direction).

Figure 1:
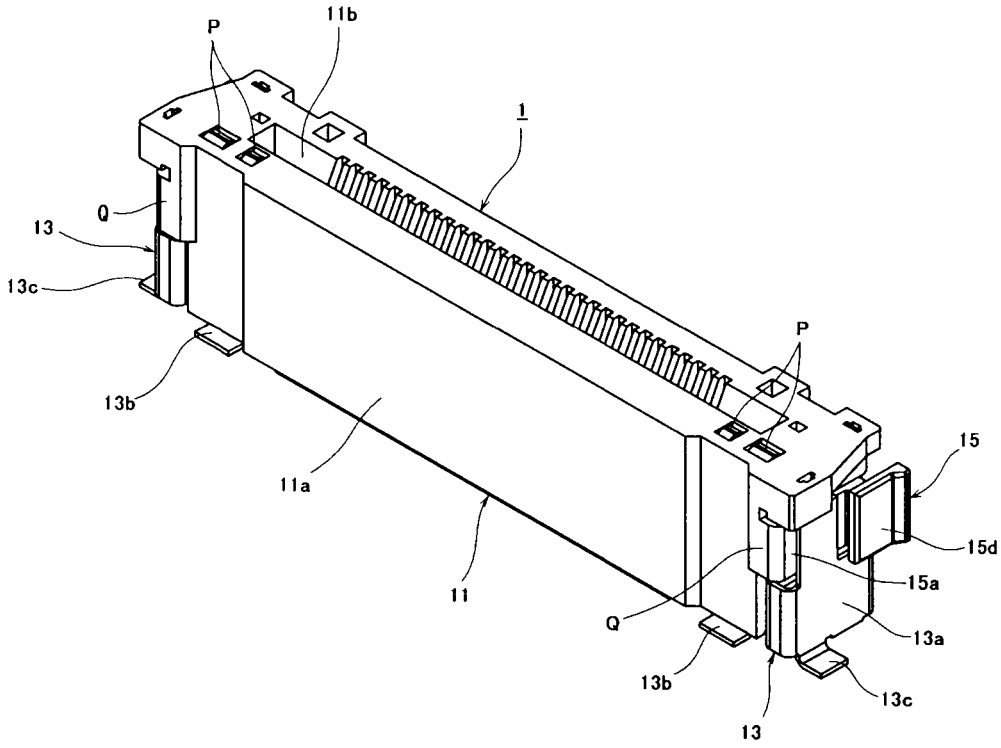
FIG. 1 is an external perspective view for describing the structure of an electric connector in isolation shown from a front according to an embodiment of the present invention.
Figure 2:
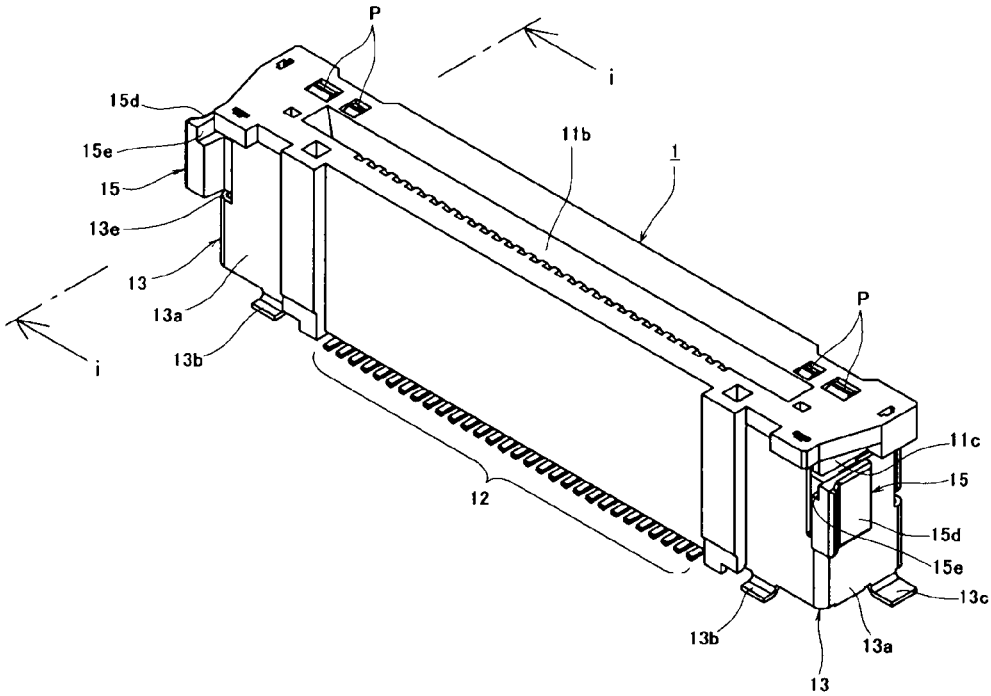
FIG. 2 is an external perspective view for describing the electrical connector depicted in FIG. 1 and viewed from a rear side.
Figure 3:
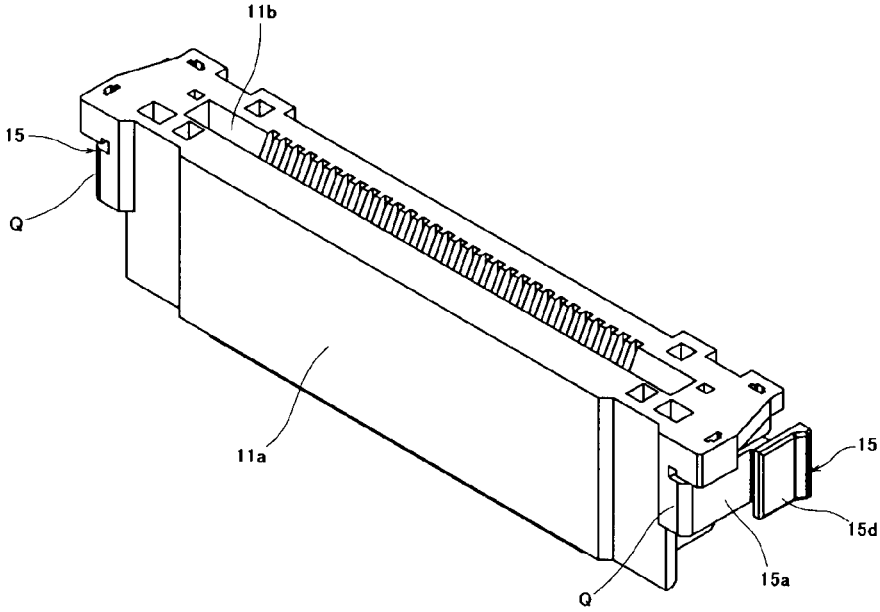
FIG. 3 is an external perspective view for describing an insulating housing for use in the electric connector depicted in FIG. 1 and FIG. 2 and viewed from a front side.
Figure 4:
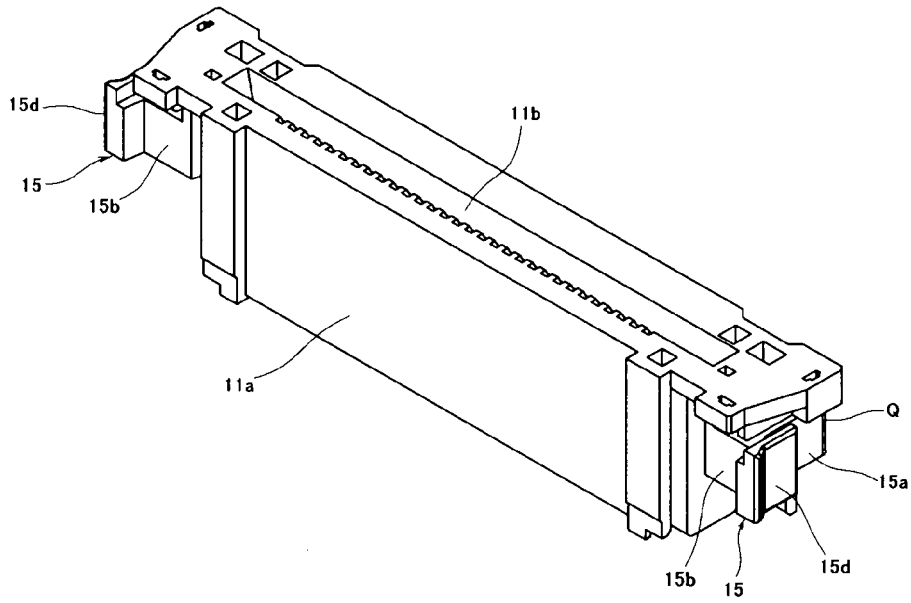
FIG. 4 is an external perspective view for describing the insulating housing depicted in FIG. 4 and viewed from a rear side.
Figure 5:
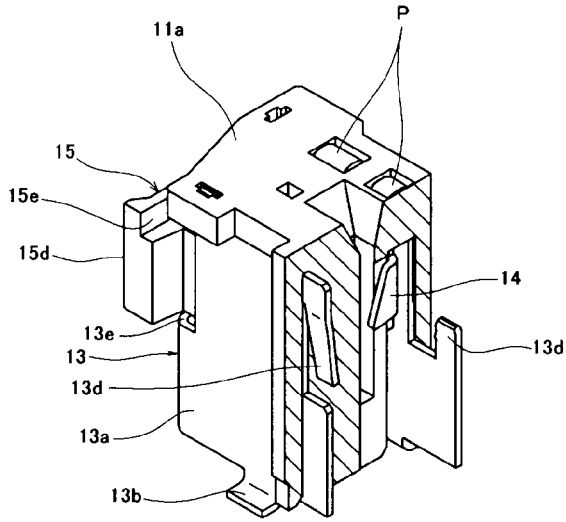
FIG. 5 is a perspective view for describing a cross section of the insulating housing along a i-i line in FIG. 2.
Figure 6:
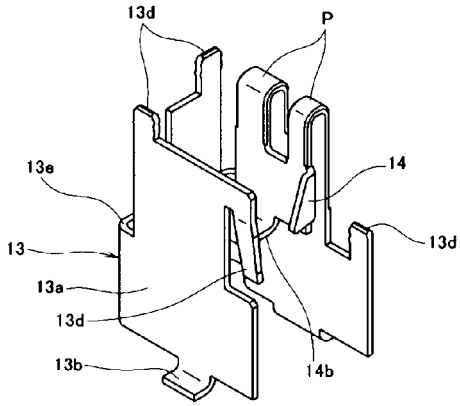
FIG. 6 is an external perspective view of a hold-down in isolation with the insulating housing removed from the state of FIG. 5.
Figure 7:
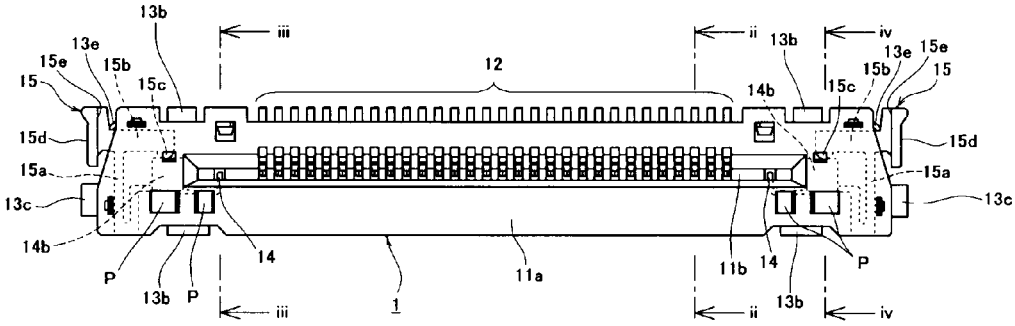
FIG. 7 is a plan view for describing the electric connector depicted in FIG. 1 and FIG. 2.
Figure 8:
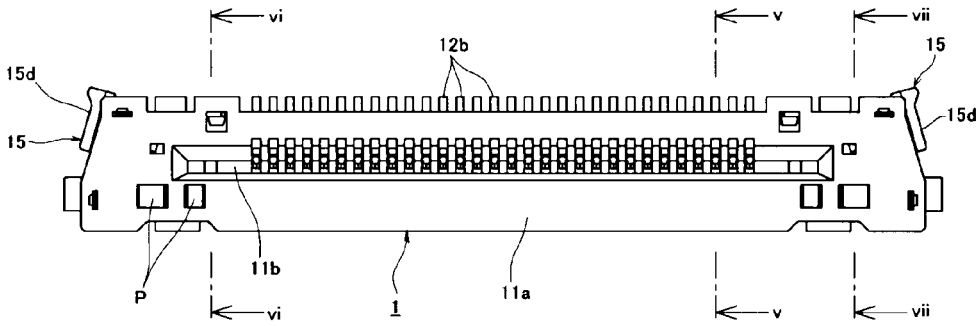
FIG. 8 is a plan view for describing the state in which an operation releasing part is operated (pressed) from the state depicted in FIG. 7.
Figure 9:
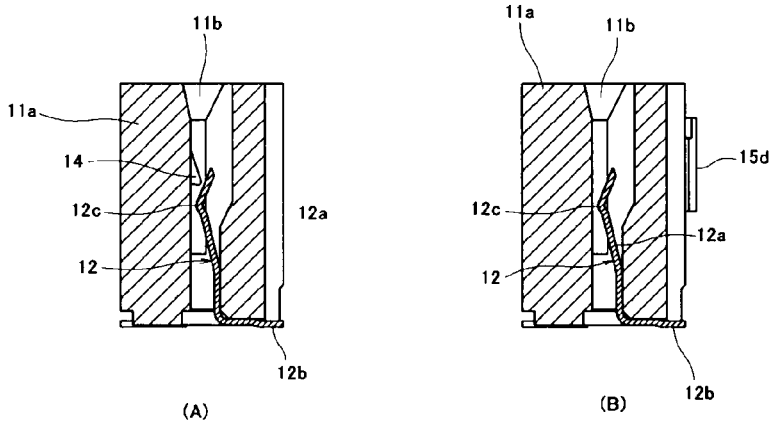
FIG. 9A and FIG. 9B depict the state of operation by the operation releasing part, FIG. 9A being a sectional cross sectional view along a ii-ii line in FIG. 7 and FIG. 9B being a sectional cross sectional view along a v-v line in FIG. 8.
Figure 10:
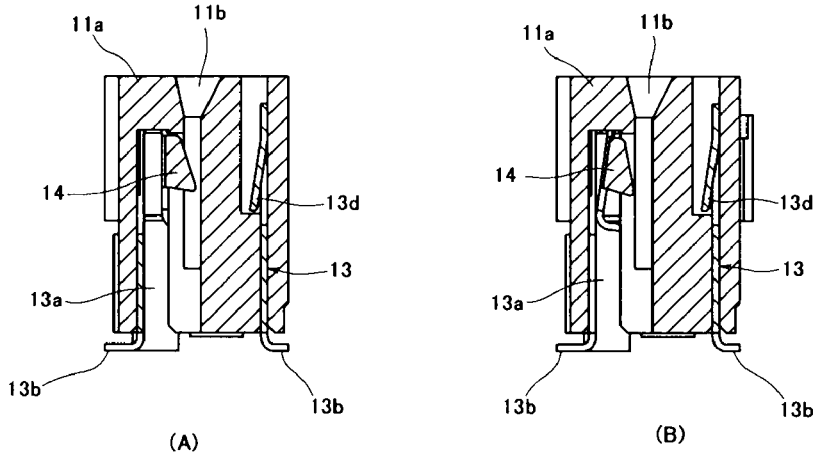
FIG. 10A and FIG. 10B depict the state of operation by the operation releasing part, FIG. 10A being a sectional cross sectional view along a iii-iii line in FIG. 7 and FIG. 10B being a sectional cross sectional view along a vi-vi line in FIG. 8.
Figure 11:
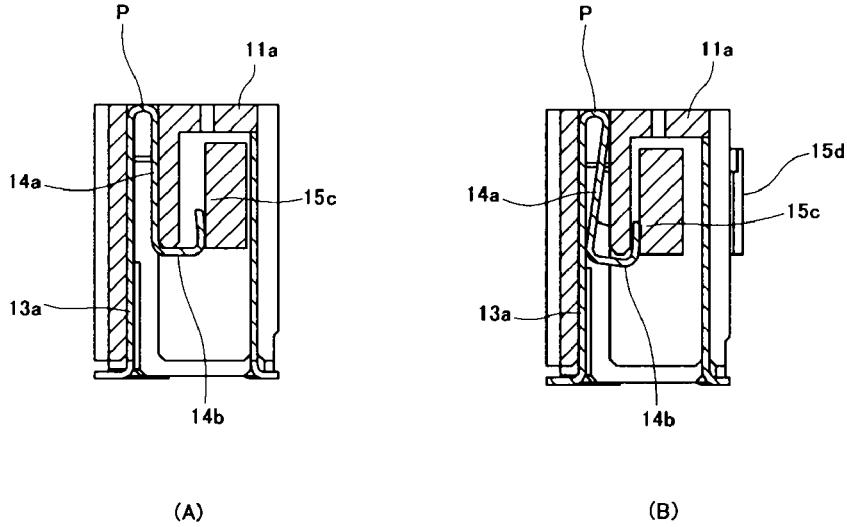
FIG. 11A and FIG. 11B depict the state of operation by the operation releasing part, FIG. 11A being a sectional cross sectional view along a iv-iv line in FIG. 7 and FIG. 11B being a sectional cross sectional view along a vii-vii line in FIG. 8.
Figure 12:
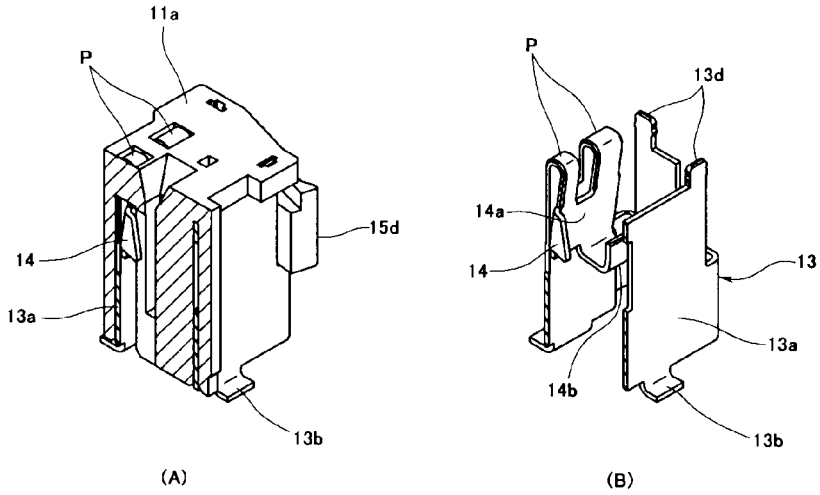
FIG. 12A and FIG. 12B depict a sectional shape along a viii-viii line in FIG. 15, FIG. 12A being a sectional perspective view for describing the state in which the connector is cut out excluding a lock member and FIG. 12B being a sectional perspective view for describing a hold-down in isolation with the insulating housing removed from the state of FIG. 12A.
Figure 13:
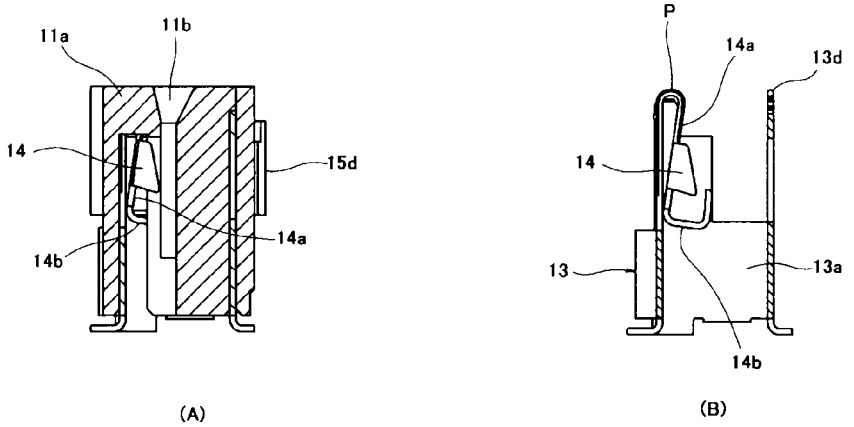
FIG. 13A and FIG. 13B depict a sectional shape along a vi-vi line in FIG. 8, FIG. 13A being a sectional view for describing the state in which the connector is cut out excluding a lock member and FIG. 13B being a sectional view for describing a hold-down in isolation with the insulating housing removed from the state of FIG. 13A.
Figure 14:
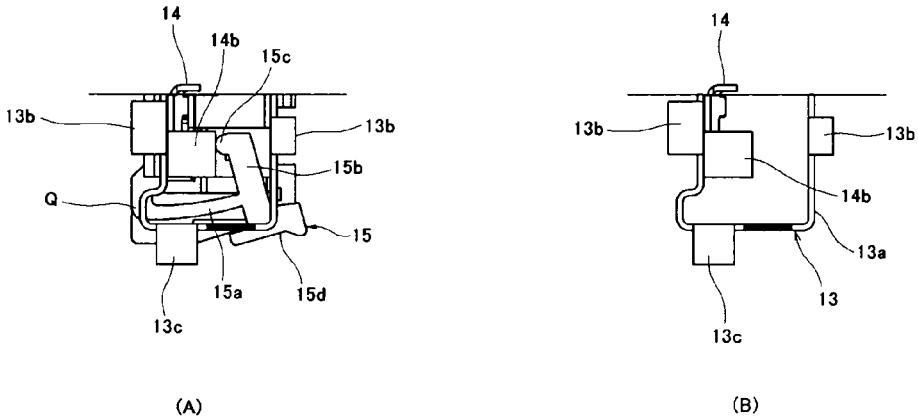
FIG. 14A and FIG. 14B depict a bottom surface of FIG. 13A and FIG. 13B, FIG. 14A being a bottom view for describing the state in which the connector is cut out excluding the lock member and FIG. 14B being a bottom view for describing the hold-down in isolation with the insulating housing removed from the state of FIG. 14A.

Still further, in particular, as depicted in FIG. 5 and FIG. 6, the upper end edge of the base frame plate 13*a* of the above-described hold down 13 is disposed so as to be adjacent to the release operating part 15*d* and the release acting part 15*d* of the lock release mechanism 15 from a lower surface side in an outer end portion in the connector longitudinal direction. The upper end edge of the base frame plate 13*a* is formed as a fourth stopper part 13*e* at a corner part facing a connecting portion between the release operating part 15*d* and the release acting part 15*b*.

First, when the release operating part 15*d* is rocked toward an operating direction, that is, an inner side in the connector longitudinal direction (connector center side), the first stopper part 15*e* of the release operating part 15*d* abuts on the first stopper part 11*c* so as to prevent the release operating part 15*d* from being excessively operated.

Also, when a force different from that in a normal use mode is exerted on the release operating part 15*d* in an outward side in the connector longitudinal direction or in an upward or downward direction, a lock release movement regulating member formed of another stopper part prevents the release operating part 15*d* from being excessively operated. That is, the second stopper part 15*f* of the release acting part 15*b* abuts on the second stopper part 11*d* for a force to the release operating part 15*d* in a direction outward in the connector longitudinal direction, the third stopper part 15*g* of the release acting part 15*b* abuts on the third stopper part 11*e* for a force in the upward direction, and the lower surface of the release acting part 15*b* abuts on the fourth stopper part 13*e* of the hold-down 13 (refer to FIG. 5 and FIG. 6) for a force in the downward direction, thereby preventing the release operating part 15*d* from being excessively operated.

As such in the present embodiment, firstly, while the state of holding the signal transmission medium by the lock member 14 is excellently maintained with the elastic action of the lock arm member 14*a* formed of the rocking member, the lock arm member 14*a* extends up to the lock member 14 on a lower rocking side from an upper end, which is one end of the connector main body 11 in the rising side where the rocking fulcrum P is provided and has a relatively long rocking radius. Therefore, the operation of releasing the lock member 14 holding the signal transmission medium PB is easily performed with a relatively small operation force.

Furthermore, since the rocking fulcrum P of the lock arm member 14*a* is disposed at the upper end, which is one end of the connector main body 11 in the rising side, a load transmitted from the lock member 14 to the lock arm member 14*a* when the signal transmission medium PB is inserted or withdrawn is received by the one end (the upper end) of the connector main body 11 in the rising side, thereby reducing a direct load on a circuit wiring board side to which the board connection leg parts 13*b*, 13*b*, and 13*c* are connected. In particular, the possibility of damages and the like can be avoided when the circuit wiring board does not have sufficient stiffness because the circuit wiring board is thin or does not have a holding member. Therefore, even when the operation of releasing the lock member 14 is repeated many times, an influence on the mount state of the connector main body 11 and others can be reduced, and the electric connection state can be stably maintained over a long period.

Still further, when the signal transmission medium PB is inserted in the insertion opening 11*b* of the connector main body 11, a positional relation between the insertion opening 11*b* of the connector main body 11 and the signal transmission medium PB can be easily observed from above. Therefore, the operation of inserting the signal transmission medium PB can be easily and accurately performed, and the state of the signal transmission medium PB after insertion can be excellently ensured.

Still further, according to the present embodiment, when the lock release operation of disengaging the lock member 14 from the signal transmission medium PB is performed, as a rocking plane of the lock release arm member 15*a*, a plane approximately orthogonal to the rocking plane of the lock arm member 14*a* is set, such as a plane approximately parallel to the circuit wiring board. Therefore, the operation force of releasing the lock member 14 is not directly exerted on the lock arm member 14*a* and the lock member 14, and the direct load on the circuit wiring board side is further reduced. In particular, according to the present embodiment, since the pressing direction when the lock release operation of disengaging the lock member 14 from the signal transmission medium PB is performed is approximately parallel to the circuit wiring board, the load is not exerted on the circuit wiring board side.

Still further, the lock release arm member 15*a* in the present embodiment is additionally provided with the release operating part 15*d* adding a rocking force to the lock release arm member 15*a*, and the release operating part 15*d* is disposed so as to protrude outward from the connector main body. Therefore, when the lock member 14 is disengaged from the signal transmission medium PB, the operation on the release operating part 15*d* is easily performed.

In addition, for the release acting part 15*b*, the release operating part 15*d*, the insulating housing 11*a*, and the hold-down 13, the first stopper parts 15*e* and 11*c*, the second stopper parts 15*f* and 11*d*, the third stopper parts 15*g* and 11*e*, and the fourth stopper part are provided, respectively, as lock release movement regulating members regulating a movement range of the release operating part 15*d*. Therefore, breakage and damage of the lock release mechanism and the connector main body can be prevented when the lock member 14 is excessively operated when being disengaged from the signal transmission medium PB and when an external force is exerted in a direction different from that in a normal use mode.

While the invention made by the inventor is specifically described based on the embodiment, the present invention is not meant to be restricted to the embodiment described above, and it goes without saying that the present invention can be variously modified within a rang not deviating from the gist of the invention. For example, the lock arm member according to the present invention can be disposed so as to extend upward from a lower end side on the circuit wiring substrate side, in contrast to the above-described embodiment.

Still further, the present invention is not meant to be restricted to an electric connector of a vertical insertion type as described in each embodiment described above, but can also be similarly applied to an electric connector of a horizontal insertion type.

Still further, the electric connector according to the present invention is not restricted to the one having a connection as in the above-described embodiment, and the present invention can also be applied to various types of electric connectors electrically connecting between boards, or a cable and a board.

As described above, the present invention can be widely applied to various types of electric connectors for use in electric apparatuses.

What is claimed is:

1. An electric connector electrically connecting a signal transmission medium to a circuit wiring board, the electric connector comprising:

a connector main body to be mounted on a surface of the circuit wiring board via a board connection leg part soldered to the circuit wiring board;

an insertion opening provided at one end of the connector main body so as to allow the signal transmission medium to be inserted in the connector main body; and a lock member holding an insertion state of the signal transmission medium by being engaged in a part of the signal transmission medium inserted from the insertion opening in the connector main body, wherein the lock member is provided to a part of an elastically-displaceable lock arm member extending like a cantilever from a rocking fulcrum disposed at the one end of the connector main body, and the electric connector is configured so that the lock member is engaged in the signal transmission medium with an elastic force of the lock arm member.

2. The electric connector according to claim 1, wherein the connector main body is provided with a lock release mechanism disengaging the lock member from the signal transmission medium, the lock release mechanism has a lock release arm member rocking in a plane approximately orthogonal to a rocking plane of the lock arm member, and is configured to rock the lock arm member with the rocking of the lock release arm member to release the lock member from the signal transmission medium.

3. The electric connector according to claim 2, wherein the connector main body is mounted so as to rise from the surface of the circuit wiring board, the lock arm member extends so as to fall from an end of the connector main body on a rising side toward the circuit wiring board, the lock release arm member is formed so as to integrally extend like a cantilever from a wall of an insulating housing configuring the connector main body, and the lock release arm member extends in a direction of a plane approximately parallel to the circuit wiring board.

4. The electric connector according to claim 3, wherein the lock release arm member is additionally provided with a release operation part adding a rocking force to the lock release arm member, and the release operation part is disposed so as to protrude outward from the connector main body.

5. The electric connector according to claim 4, wherein the insulating housing is provided with a lock release movement regulating member regulating a moving range of the lock release arm member or the release operation part.

* * * * *